US006299289B1

(12) United States Patent
Silverbrook

(10) Patent No.: US 6,299,289 B1
(45) Date of Patent: Oct. 9, 2001

(54) INKJET PRINTHEAD WITH NOZZLE POKERS

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/425,416

(22) Filed: Oct. 19, 1999

(30) Foreign Application Priority Data

Sep. 11, 1998 (AU) ..... PP7022

(51) Int. Cl.[7] ..... B41J 2/04; B41J 2/015; B41J 2/135

(52) U.S. Cl. ..... 347/54; 347/20; 347/44

(58) Field of Search ..... 347/54, 20, 44, 347/75, 90

(56) References Cited

U.S. PATENT DOCUMENTS 6,027,205 * 2/2000 Herbert ..... 347/54

* cited by examiner

*Primary Examiner*—Thinh Nguyen

(57) ABSTRACT

An inkjet printhead, typically constructed by MEMS process, includes a large number of nozzle chambers with ink ejection nozzle apertures and a paddle moveable in each chamber by an actuator to deliver ink through the nozzle. Each paddle is provided with a projecting poker, concentrically protruding through the nozzle aperture when actuated to inhibit clogging of the nozzle.

10 Claims, 5 Drawing Sheets

INKJET PRINTHEAD WITH NOZZLE POKERS

FIELD OF THE INVENTION

The present invention relates to the field of fluid ejection devices such as inkjet printers and, in particular, discloses the utilization of a poker on the ink ejection paddle.

BACKGROUND OF THE INVENTION

Many different types of printing have been invented, a large number of which are presently in use. The known forms of printers have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques of ink jet printing have been invented. For a survey of the field, reference is made to an article by J Moore, "Non-Impact Printing: Introduction and Historical Perspective", Output Hard Copy Devices, Editors R Dubeck and S Sherr, pages 207–220 (1988).

Ink Jet printers themselves come in many different types. The utilisation of a continuous stream ink in ink jet printing appears to date back to at least 1929 wherein U.S. Pat. No. 1,941,001 by Hansell discloses a simple form of continuous stream electrostatic ink jet printing.

U.S. Pat. No. 3,596,275 by Sweet also discloses a process of a continuous ink jet printing including the step wherein the ink jet stream is modulated by a high frequency electrostatic field so as to cause drop separation. This technique is still utilized by several manufacturers including Elmjet and Scitex (see also U.S. Pat. No. 3,373,437 by Sweet et al)

Piezo-electric ink jet printers are also one form of commonly utilized ink jet printing device. Piezo-electric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezo electric crystal, Stemme in U.S. Pat. No. 3,747,120 (1972) discloses a bend mode of piezo-electric operation, Howkins in U.S. Pat. No. 4,459,601 discloses a Piezo electric push mode actuation of the ink jet stream and Fischbeck in U.S. Pat. No. 4,584,590 which discloses a sheer mode type of piezo-electric transducer element.

Recently, thermal ink jet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques rely upon the activation of an electrothermal actuator which results in the creation of a bubble in a constricted space, such as a nozzle, which thereby causes the ejection of ink from an aperture connected to the confined space onto a relevant print media. Printing devices utilizing the electrothermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

Recently, the present applicant has disclosed for example, an Australian Provisional Patent No. PP6534 entitled "Micromechanical Device and Method (IJ46a)", filed Oct. 16, 1998 a new form of ink jet printer containing an ink ejection mechanism that includes a thermal bend actuator actuated in an external ambient environment which is interconnected with a paddle mechanism utilised for the ejection of ink.

Unfortunately, in the aforementioned ink jet printing arrangement as in most ink jet printing arrangements, there is a tendency of the ink ejection nozzles to dry out over time which can result in the build up of crustaceans etc. Further, there is also the propensity of such devices to become clogged by other means such as foreign bodies in the ink or paper fibres, material etc. around the ink ejection nozzle.

Further, in the aforementioned arrangement, there is a significant gap left in one wall of the ink ejection chamber, the gap being required and utilized by the movement of the thermal actuator up and down during an ejection cycle. Unfortunately, the provision of the slot may cause ink flow to wick out of the nozzle chamber and along the thermal actuator which can cause problems with ink loss due to wicking. Such ink loss is generally undesirable.

SUMMARY OF THE INVENTION

In accordance with a first aspect of the present invention, there is provided an inkjet printhead comprising:

- a plurality of nozzle chambers, each having a nozzle aperture defined in one wall thereof for the ejection of ink out of said aperture;
- an ink supply channel interconnected with said nozzle chamber;
- a paddle moveable within the nozzle chamber by an actuator and operable to eject ink from said nozzle chamber, said paddle having a projecting part which, upon operation of said actuator is caused to move towards said nozzle aperture.

Preferably, the projecting part, upon activation of the actuator, moves through the plane of the aperture and can be located concentrically with the nozzle aperture.

The liquid ejection aperture can be formed utilizing the deposition and etching of a series of layers and the projecting part can comprise a hollow cylindrical column.

The hollow cylindrical column preferably can include an end adjacent the aperture which can be chemically mechanically planarized during the formation of the aperture.

The actuator can comprise a thermal bend actuator conductively heated so as to cause movement of the paddle.

The projecting part can be located substantially centrally on the paddle.

In accordance with a further aspect of the present invention, there is provided in an inkjet printhead having at least one chamber from which liquid is ejected from a nozzle aperture interconnected with said chamber by means of movement of a liquid ejection paddle, a method of improving the operational characteristics of said printhead comprising the steps of:

locating a projecting part on said moveable paddle, said projecting part undergoing movement towards said nozzle aperture upon activation of said liquid ejection paddle to eject fluid.

The projection part preferably can include an end portion which moves through the plane of an outer rim of the aperture upon activation of the liquid ejection paddle.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED EMBODIMENTS

In the preferred embodiment, a paddle is formed with a "poker" device attached in a central portion thereof such that, during movement of the paddle, the poker device pokes any unwanted foreign body or material which should congregate around the nozzle, out of the nozzle. The poker can be formed during fabrication of the ink ejection nozzle arrangement by means of a chemical mechanical planarization step with, preferably, the formation being a byproduct of the normal formation steps for forming the ink ejection nozzle on arrangement on a semi-conductor wafer utilizing standard MEMS processing techniques.

Additionally, in order to restrict the amount of wicking and the opportunities for wicking, an actuator slot guard is provided, formed on the bend actuator itself, closely adjacent to the actuator slot so as to restrict the opportunities for flow of fluid out of the nozzle chamber due to surface tension effects.

Figure 1:
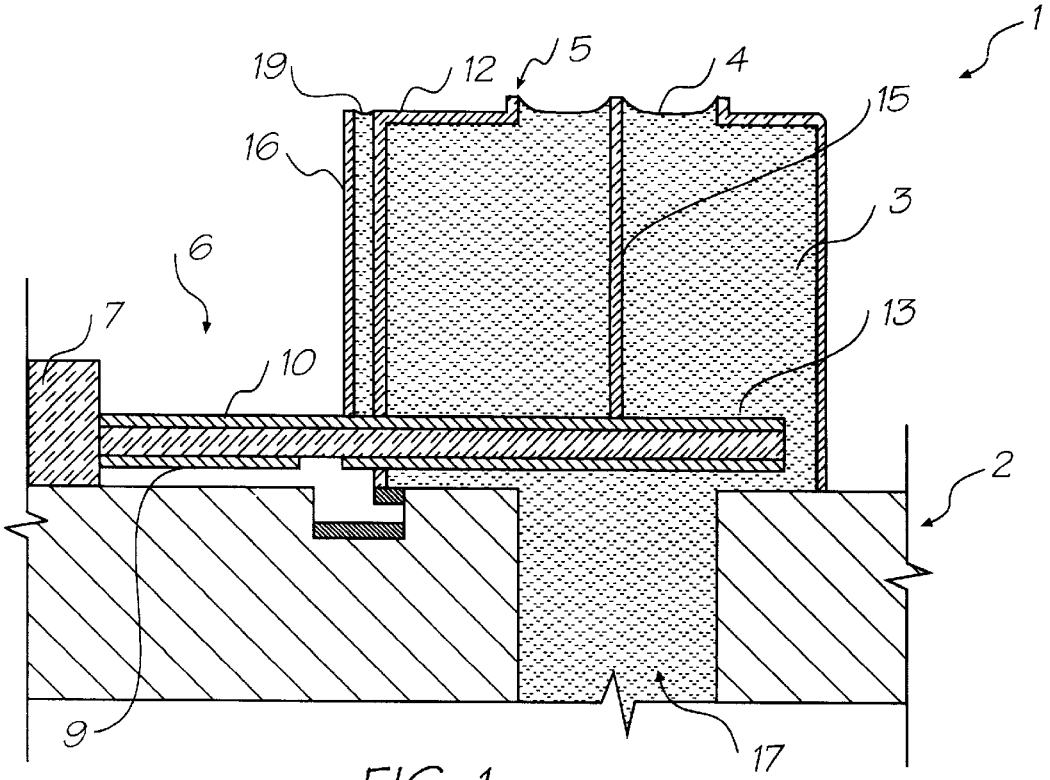
FIGS. 1–3 illustrates schematically the operational principles of the preferred embodiments.
Figure 2:
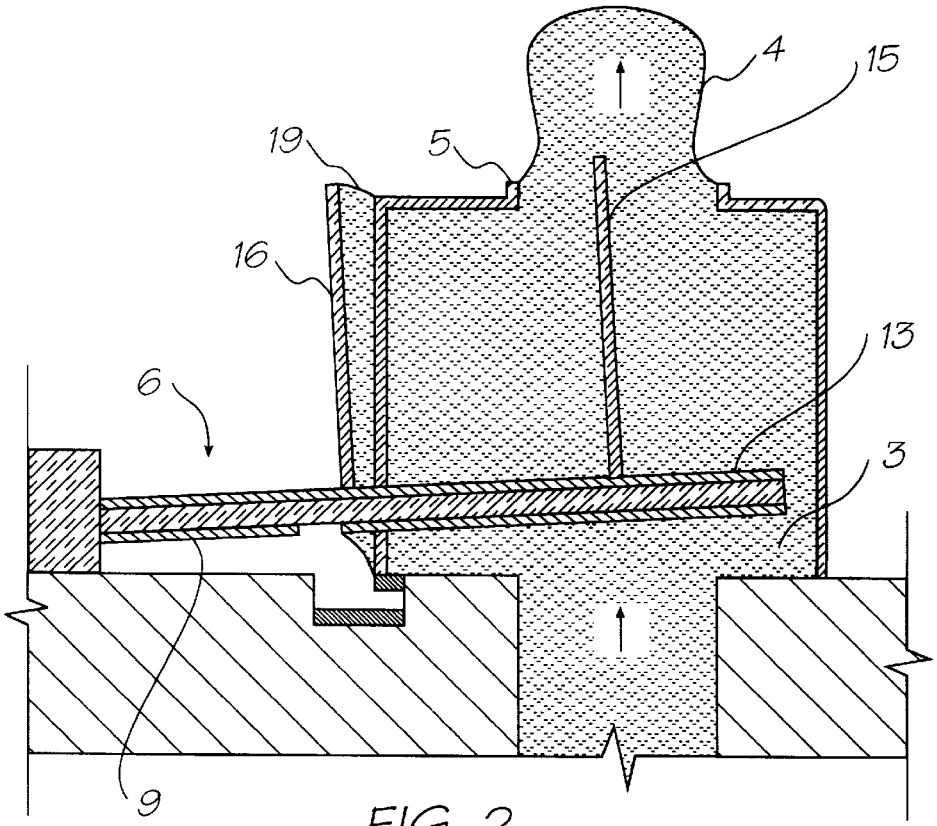
Figure 3:
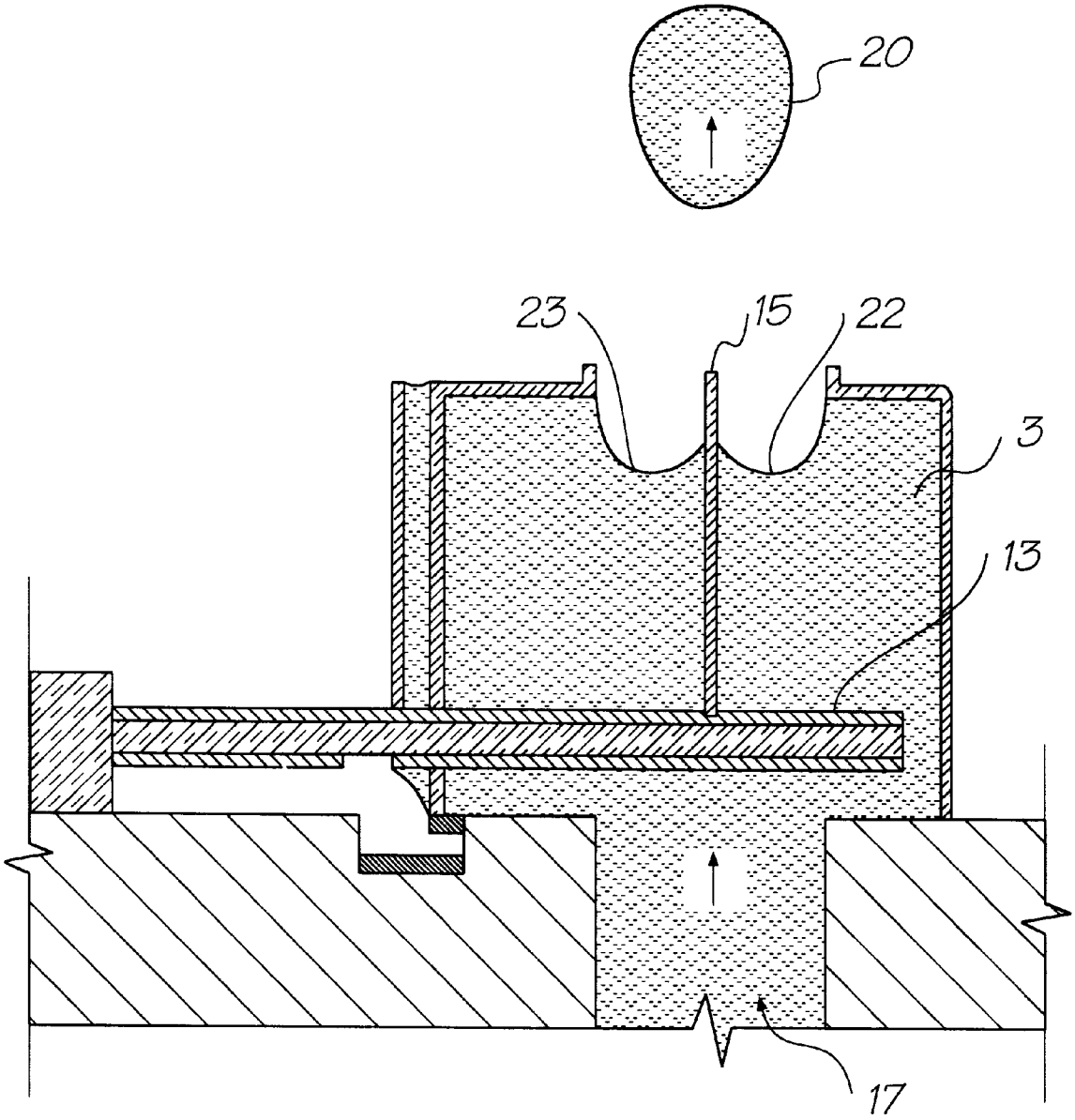

Turning now to FIG. 1 to FIG. 3 there will now be explained the operational principles of the preferred embodiment. In FIG. 1, there is illustrated a nozzle arrangement 1 which is formed on the substrate 2 which can comprise a semi-conductor substrate or the like. The arrangement 1 includes a nozzle chamber 3 which is normally filled with ink so as to form a meniscus 4 which surrounds a nozzle rim 5. A thermal bend actuator device 6 is attached to post 7 and includes a conductive heater portion 9 which is normally balanced with a corresponding layer 10 in thermal equilibrium. The actuator 6 passes through a slot in the wall 12 of the nozzle chamber and inside forms a nozzle ejection paddle 13. On the paddle 13 is formed a "poker" 15 which is formed when forming the walls of the nozzle chamber 3. Also formed on the actuator 6 is a actuator slot protection barrier 16. An ink supply channel 17 is also formed through the surface of the substrate 2 utilizing highly anisotropic etching of the substrate 2. During operation, ink flows out of the nozzle chamber 3 so as to form a layer 19 between the slot in the wall 12 and the actuator slot protection barrier 16. The protection barrier is profiled to substantially mate with the slot but to be slightly spaced apart therefrom so that any meniscus eg. 19 is of small dimensions.

Next, as illustrated in FIG. 2, when it is desired to eject a drop from the nozzle chamber 3, the bottom conductive thermal actuator 9 is heated electrically so as to undergo a rapid expansion which in turn results in the rapid upward movement of the paddle 13. The rapid upward movement of the paddle 13 results in ink flow out of the nozzle so as to form bulging ink meniscus 4. Importantly, the movement of the actuator 6 results in the poker 15 moving up through the plane of the nozzle rim so as to assist in the ejection of any debris which may be in the vicinity of the nozzle rim 5.

Further, the movement of the actuator 6 results in a slight movement of the actuator slot protection barrier 16 which maintains substantially the small dimensioned meniscus 19 thereby reducing the opportunity for ink wicking along surfaces. Subsequently, the conductive heater 9 is turned off and the actuator 6 begins to rapidly return to its original position. The forward momentum of the ink around meniscus 4 in addition to the backflow due to return movement of the actuator 6 results in a general necking and breaking of the meniscus 4 so as to form a drop.

The situation a short time later is as illustrated in FIG. 3 where a drop 20 proceeds to the print media and the meniscus collapses around poker 15 so as to form menisci 22, 23. The formation of the menisci 22, 23 result in a high surface tension pressure being exerted in the nozzle chamber 3 which results in ink being drawn into the nozzle chamber 3 via ink supply channel 17 so as to rapidly refill the nozzle chamber 3. The utilization of the poker 15 increases the speed of refill in addition to ensuring that no air bubble forms within the nozzle chamber 3 by means of the meniscus attaching to the surface of the nozzle paddle 13 and remaining there. The poker 15 ensures that the meniscus eg. 22, 23 will run along the poker 15 so as to refill in the nozzle chamber. Additionally, the area around the actuator slot barrier 16 remains substantially stable minimizing the opportunities for wicking therefrom.

Figure 4:
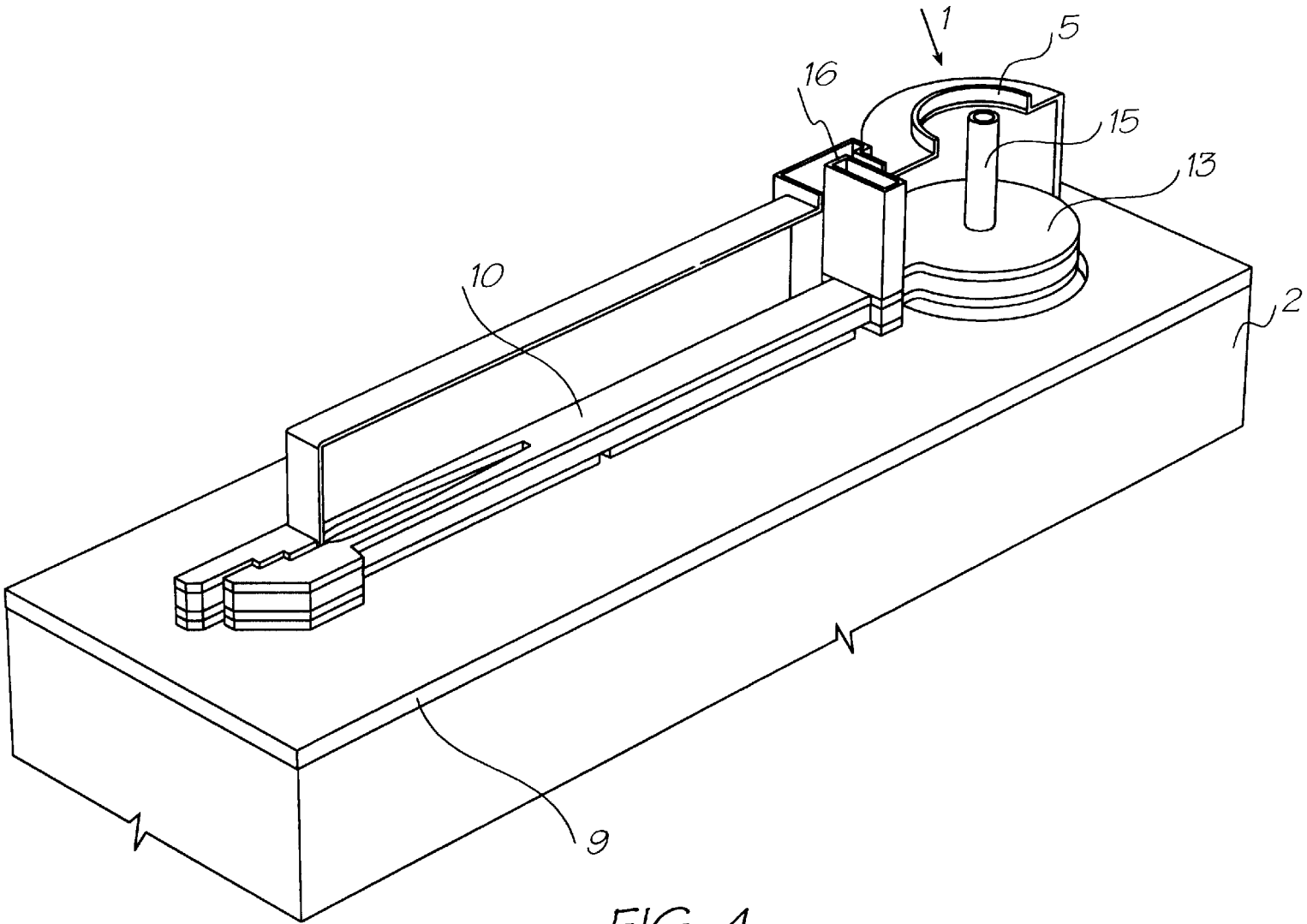
FIG. 4 is a side perspective view, partly in section, of a single nozzle arrangement of the preferred embodiment.
Figure 5:
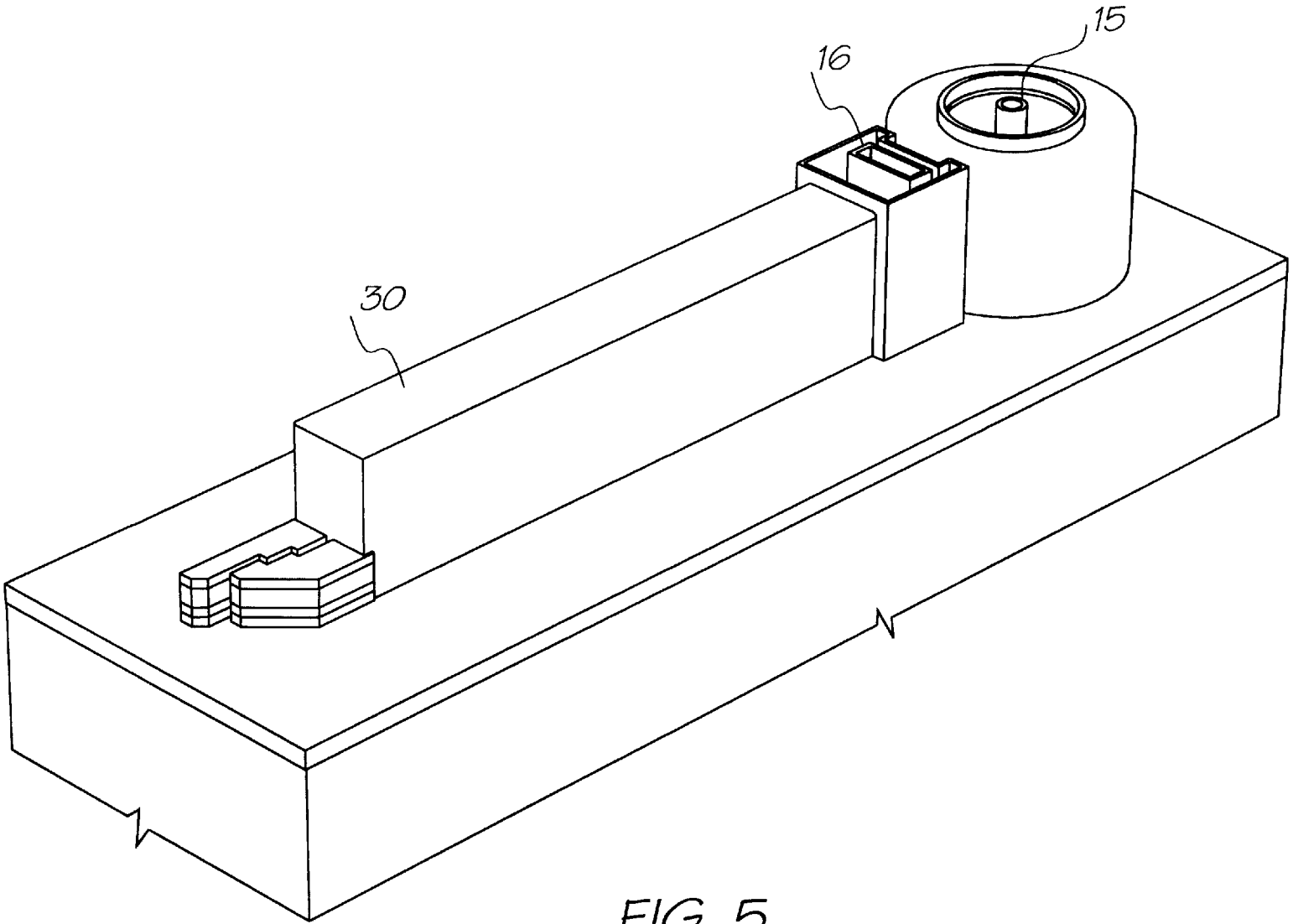
FIG. 5 illustrates a side perspective of a single nozzle including the shroud arrangement.
Figure 6:
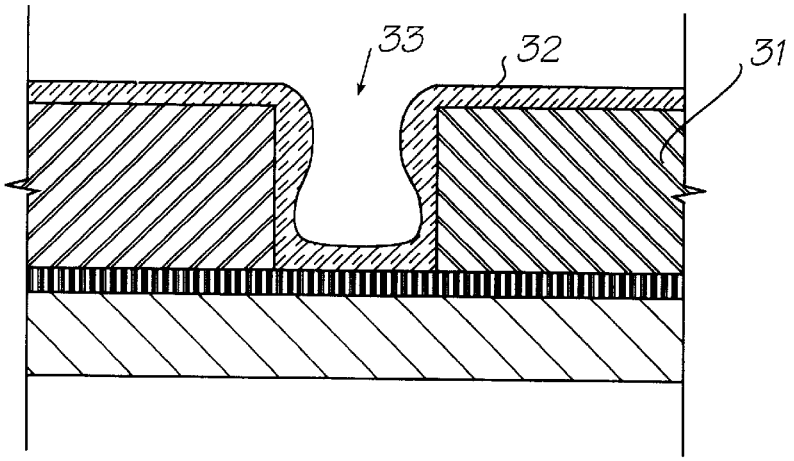
FIGS. 6 to 8 illustrates the principles of chemical, mechanical planarization utilized in the formation of the preferred embodiment.
Figure 7:
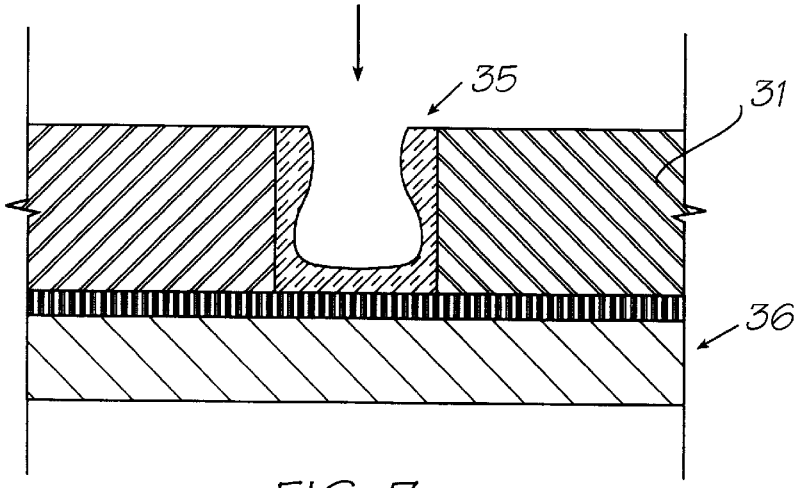
Figure 8:
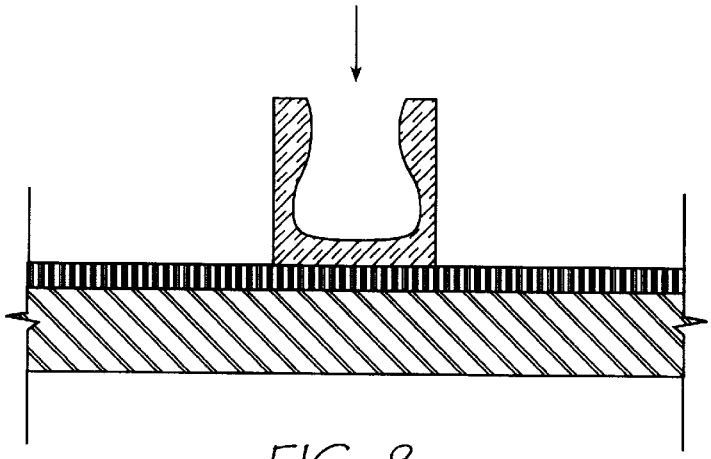

Turning now to FIG. 4 there is illustrated a side perspective view of a single nozzle arrangement 1 shown in sections. FIG. 5 illustrates a side perspective view of a single nozzle including a protective shroud 30. The central poker 15 and aperture card 16 are as previously discussed. The construction of the arrangement of FIGS. 4 and 5 can be as a result of the simple modification of deep mask steps utilized in the construction of the nozzle arrangement in Australian Provisional Patent Application PP6534 (the contents of which are specifically incorporated by cross-reference) so as to include the poker 15 and guard 16. The poker and guard are constructed primarily by means of a chemical mechanical planarization step which is illustrated schematically in FIG. 6 to FIG. 8. The poker 15 and guard 16 are constructed by depositing a surface layer 32 on a sacrificial layer 31 which includes a series of etched vias eg. 33. Subsequently, as illustrated in FIG. 7, the top layer is chemically and mechanically planarized off so as to leave the underlying structure 35 which is attached to lower structural layers 36. Subsequently, as illustrated in FIG. 8, the sacrificial layer 31 is etched away leaving the resulting structure as required.

It would be appreciated by a person skilled in the art that numerous variations and/or modifications may be made to the present invention as shown in the specific embodiment without departing from the spirit or scope of the invention as broadly described. The present embodiment is, therefore, to be considered in all respects to be illustrative and not restrictive.

What is claimed is:

1. An inkjet printhead comprising:

a plurality of nozzle chambers, each having a nozzle aperture defined in one wall thereof for the ejection of ink out of said aperture;

an ink supply channel interconnected with said nozzle chamber;

a paddle moveable within the nozzle chamber by an actuator and operable to eject ink from said nozzle chamber, said paddle having a projecting part which, upon operation of said actuator is caused to move towards said nozzle aperture.

2. An inkjet printhead as claimed in claim 1 wherein said projecting part, upon operation of said actuator, moves through the plane of said aperture.

3. An inkjet printhead as claimed in claim 1 wherein said projecting part is located concentrically with said nozzle aperture.

4. An inkjet printhead as claimed in claim 1 wherein said nozzle aperture is formed by MEMS process utilizing the deposition and etching of a series of layers and said projecting part comprises a hollow cylindrical column.

5. An inkjet printhead as claimed in claim 4 wherein said hollow cylindrical column includes a proximal end at the paddle and a distal end adjacent said aperture, said distal end being chemically mechanically planarized during the formation of said aperture.

6. An inkjet printhead as claimed in claim 1 wherein said actuator comprises a thermal bend actuator conductively heated so as to cause movement of said paddle.

7. An inkjet printhead as claimed in claim 1 wherein said projecting part is located substantially centrally on said paddle.

8. In an inkjet printhead having at least one chamber from which liquid is ejected from a nozzle aperture interconnected with said chamber by means of movement of a liquid ejection paddle, a method of improving the operational characteristics of said printhead comprising the steps of:

locating a projecting part on said moveable paddle, said projecting part undergoing movement towards said nozzle aperture upon activation of said liquid ejection paddle to eject liquid.

9. A method as claimed in claim 8 wherein said projecting part includes an end portion which moves through the plane of a rim of said aperture upon activation of said liquid ejection paddle.

10. A method as claimed in either claim 8 or claim 9 wherein said projecting part is arranged substantially concentrically with the nozzle aperture.

* * * * *